US010245628B2

(12) United States Patent
Pourbashiri et al.

(10) Patent No.: US 10,245,628 B2
(45) Date of Patent: Apr. 2, 2019

(54) ULTRA-FINE WIRE FABRICATING APPARATUS AND METHOD

(71) Applicants: Mojtaba Pourbashiri, Tehran (IR); Mohammad Sedighi, Tehran (IR); Christof Sommitsch, Graz (AT)

(72) Inventors: Mojtaba Pourbashiri, Tehran (IR); Mohammad Sedighi, Tehran (IR); Christof Sommitsch, Graz (AT)

( * ) Notice: Subject to any disclaimer, the term of this patent is extended or adjusted under 35 U.S.C. 154(b) by 0 days.

(21) Appl. No.: 15/421,379

(22) Filed: Jan. 31, 2017

(65) Prior Publication Data

US 2017/0252788 A1 Sep. 7, 2017

(51) Int. Cl.

| | |
|---|---|
| ***B21C 1/04*** | (2006.01) |
| ***B21C 23/08*** | (2006.01) |
| ***B21C 23/00*** | (2006.01) |
| ***B21C 1/00*** | (2006.01) |
| ***C21D 7/10*** | (2006.01) |
| *B21C 25/02* | (2006.01) |
| *C21D 9/52* | (2006.01) |

(52) U.S. Cl.

CPC ..... *B21C 1/04* (2013.01); *B21C 1/003* (2013.01); *B21C 23/001* (2013.01); *B21C 23/08* (2013.01); *C21D 7/10* (2013.01); *B21C 25/02* (2013.01); *C21D 9/525* (2013.01); *C21D 2201/03* (2013.01)

(58) Field of Classification Search

CPC .. B21C 1/04; B21C 3/12; B21C 1/003; B21C 3/14; B21C 23/00; B21C 23/001; B21C 23/08; B21C 25/02; B21C 23/02; B21F 1/006; B21F 1/023; B21F 7/00

See application file for complete search history.

(56) References Cited

U.S. PATENT DOCUMENTS 2,616,478 A * 11/1952 D'Avaucourt ..... B21C 37/045 140/149
3,285,047 A * 11/1966 Crawford ..... B21D 3/08 140/147
3,961,514 A * 6/1976 Geary ..... B21F 7/00 72/274

(Continued)

FOREIGN PATENT DOCUMENTS

JP 06134516 A * 5/1994

OTHER PUBLICATIONS

Machine translation of JP 06134516 A.*

*Primary Examiner* — Edward T Tolan

(57) ABSTRACT

The ultra-fine wire fabricating apparatus comprises a feeder assembly, a stationary die, and a rotary die holder. The feeder assembly supplies a wire. The stationary die comprises a hollow inclined channel configured on an inner surface of the stationary die. The hollow inclined channel is configured to receive the wire from the feeder assembly. The rotary die holder configured to receive the wire from the stationary die and simultaneously torsionally deform the wire, wherein the rotary die holder rotates relative to the stationary die to produce the ultra-fine wire with improved mechanical properties. The method ensures continuous grain refinement of wires. The wires are severe plastic deformed using the combined effects of the stationary die and rotary die holder. The mechanical properties of the raw materials are improved due to a grain refinement and microstructure evolution caused by plastic deformation.

2 Claims, 7 Drawing Sheets

(56) References Cited

U.S. PATENT DOCUMENTS

| | | | | |
|---|---|---|---|---|
| 5,601,857 | A * | 2/1997 | Friedrichs | B21C 23/147 264/209.2 |
| 6,895,795 | B1 * | 5/2005 | Chaudhury | B21C 23/00 72/253.1 |
| 7,140,222 | B2 * | 11/2006 | Park | B21C 23/001 72/262 |
| 7,950,126 | B2 * | 5/2011 | Hammock | B21C 37/045 148/23 |
| 8,516,868 | B2 * | 8/2013 | Rhee | B21C 23/001 148/538 |
| 2005/0081594 | A1 * | 4/2005 | Segal | B21C 23/001 72/253.1 |
| 2006/0130549 | A1 * | 6/2006 | Zhu | B21C 23/005 72/262 |
| 2012/0196092 | A1 * | 8/2012 | Rottger | B21H 3/12 428/174 |
| 2016/0168678 | A1 * | 6/2016 | Li | C22F 1/06 148/557 |

* cited by examiner

ULTRA-FINE WIRE FABRICATING APPARATUS AND METHOD

BACKGROUND OF THE INVENTION

Ultra-fine grain materials have attracted the attention of many researchers due to their unique mechanical properties. Control of grain size and texture are known as one of the most effective ways to achieve desired material properties. Severe plastic deformation (SPD) processes are commonly used methods for grain refinement of metallic materials, although they have not been well received by industry. The most important limitations of introduced methods are the small size of the product and the large number of steps needed to reach the desired texture. In recent years, various SPD methods for improving texture and grain size of bars with small diameters are provided. However, imposing large plastic strain to small diameter wires is a complex process and technically challenging. Traditionally, wires are made by drawing; imposing sever plastic deformation to wires with small diameter is a complex process.

Enhancing mechanical properties of wires during fabrication is highly desirable for the production of high strength, durable, and ductile wires. Several methods have been proposed over the years for the improvement of the mechanical properties of wires. For example, severe plastic deformation (SPD) methods for fabricating nano-structured materials have been used with positive results. However, metal wires fabricated from such methods suffer from low ductility due to lack of work hardening.

It has been shown that one of the possible solutions to tackle this problem is to introduce non-uniform grain structure, i.e., mixture of both fine grains (to improve strength) and coarse grains to keep reasonable ductility level. An apparatus, which produces a non-uniform grain structure in the fabricated wire, is required. Furthermore, in other existing SPD methods for fabricating wires with small cross section, each method has some disadvantages such as the limited length of the final product, low speed, low production rate, etc. An apparatus or a method, which has the ability to impose continuous plastic deformation to wires with acceptable speed and high production rate is required.

Conventionally, most of the severe plastic deformation (SPD) methods use a die with an intersection angle to impose a plastic shear strain to the raw materials. In these processes, the amount of achievable plastic strain is limited with respect to the die angle. In order to attain a higher level of plastic strain the intersection angle of a die should be decreased. However, in practice, the use of intersection angles less than 90° is difficult. An apparatus or method, which is capable of achieving the highest level of plastic strain, is required. Moreover, an apparatus which produces a continuous torsion deformation to a wire with diameter below 4 mm, is required.

There is a long felt but unresolved need for an apparatus, which produces a non-uniform grain structure in the fabricated wire. Moreover, there is a need for an apparatus or a method, which has the ability to impose continuous plastic deformation to wires with acceptable speed and high production rate. Furthermore, there is a need for an apparatus or method, which is capable of achieving the highest level of plastic strain. Additionally, there is a need for an apparatus, which produces a continuous torsion deformation to a wire with diameter below 4 mm.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The ultra-fine wire fabricating apparatus, disclosed herein, addresses the above-mentioned need for an apparatus, which produces a non-uniform grain structure in the fabricated wire. Moreover, the invention addresses the need for an apparatus or a method, which has the ability to impose continuous plastic deformation to wires with acceptable speed and high production rate. Furthermore, the invention addresses the need for an apparatus or method, which is capable of achieving the highest level of plastic strain.

Additionally, the invention addresses the need for an apparatus, which produces a continuous torsion deformation to a wire with diameter below 4 mm. The ultra-fine wire fabricating apparatus, disclosed herein, comprises a feeder assembly, a stationary die, and a rotary die holder. The feeder assembly supplies a wire. The stationary die comprises a hollow inclined channel configured on an inner surface of the stationary die. The hollow inclined channel is configured to receive the wire from the feeder assembly. The rotary die holder configured to receive the wire from the stationary die and simultaneously torsionally deform the wire, wherein the rotary die holder rotates relative to the stationary die to produce the ultra-fine wire with improved mechanical properties.

One aspect of the present disclosure is directed to an ultra-fine wire fabricating apparatus for producing an ultra-fine wire with improved mechanical properties, the ultra-fine wire fabricating apparatus comprising: (a) a feeder assembly for supplying a wire; (b) a stationary die comprising a hollow inclined channel configured on an inner surface of the stationary die, the hollow inclined channel configured to receive the wire from the feeder assembly; and (c) a rotary die holder configured to receive the wire from the stationary die and simultaneously torsionally deform the wire, wherein the rotary die holder rotates relative to the stationary die to produce the ultra-fine wire with improved mechanical properties.

In one embodiment, the ultra-fine wire fabricating apparatus further comprises a pick-up spool assembly operably engaged to the rotary die holder for collecting the fabricated ultra-fine wire. In one embodiment, the ultra-fine wire fabricating apparatus further comprises a control unit for controlling one or more parameters of the ultra-fine wire fabricating apparatus. In a related embodiment, the one or more parameters comprise a rotational speed of the rotary die holder, a drawing speed of a drawing block, and a rate of fabrication of the ultra-fine wire. In another related embodiment, the one or more parameters comprise a diameter of the ultra-fine wire, a length of the ultra-fine wire, and a quantity of the ultra-fine wire.

Another aspect of the present disclosure is directed to a method for producing an ultra-fine wire with improved mechanical properties, the method comprising: (a) providing an ultra-fine wire fabricating apparatus comprising: (i) a feeder assembly; (ii) a stationary die; and (iii) a rotary die holder; (b) supplying a wire via the feeder assembly; (c) bending the wire in a hollow inclined channel of the stationary die; and (d) applying a torsion deformation on the wire by rotating the rotary die holder to produce the ultra-fine wire with improved mechanical properties.

The ultra-fine wire fabrication method, also referred to as the "Equal channel angular torsion drawing (ECATD) method" is introduced as a method for continuous grain refinement of wires. During the ECATD process, the initial wires are severe plastic deformed using the combined effects of an equal channel angular die and torsional deformation. The mechanical properties of the raw materials are improved due to a grain refinement and microstructure evolution caused by the severe plastic deformation.

By this method, the wires with enhanced mechanical properties can be produced continuously. So, this new hybrid process can be used as an industrial method for continuous grain refinement of wires. In the method, the advantage is the ability to impose continuous severe plastic deformation to wires with acceptable speed and high production rate. In addition, this new technique is simple and cheap. There is no need for expensive equipment and facilities.

In the equal channel angular torsion deformation (ECATD) method, the wires are continuously drawn and torsion deformed during each pass of the process. Therefore, there are no limits for the length of the final product. In addition, with the aid of the intersection angle of the die channel and torsion deformation, large plastic deformation near 1~1.5 could be achieved in one pass of the process. By repeating the ECATD process, an equivalent plastic strain up to 4-5 can be imposed to the initial wire. In addition, by controlling the process parameters a higher level of plastic strain can be achieved in each pass. Wires with different materials and diameters can be severe plastic deformed by this method.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION

Figure 1:
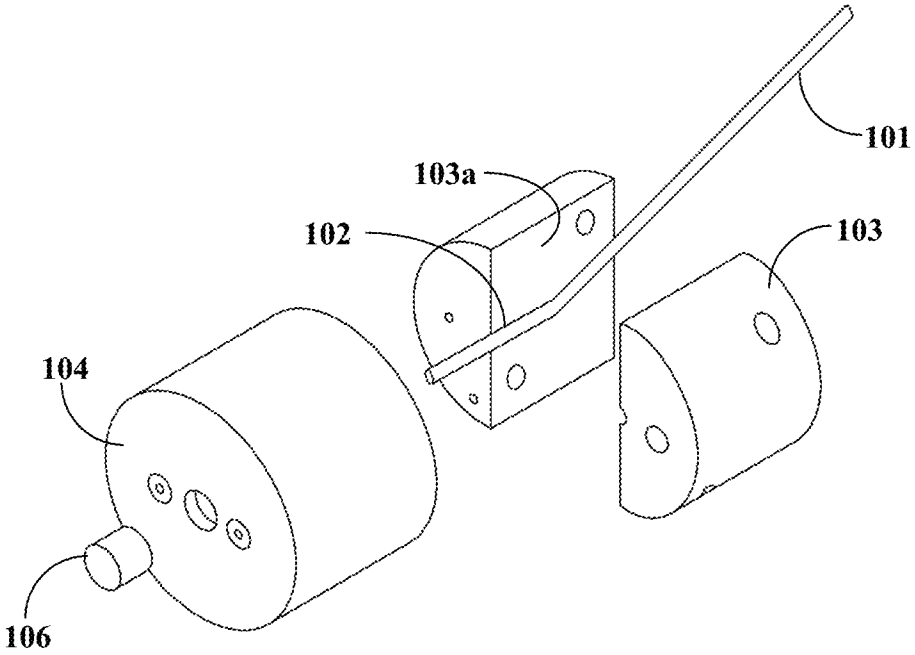
FIG. 1 exemplarily illustrates a schematic diagram of an ultra-fine wire fabrication method.

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The present invention generally relates to wire fabrication apparatuses. More particularly, the invention disclosed herein relates to an ultra-fine wire fabricating apparatus and method for producing ultra-fine wire with improved mechanical properties.

Conventionally, most of the severe plastic deformation (SPD) methods use a die with an intersection angle to impose a plastic shear strain to the raw materials. In these processes, the amount of achievable plastic strain is limited with respect to the die angle. In order to attain a higher level of plastic strain the intersection angle of a die should be decreased. However, in practice, the use of intersection angles less than 90° is difficult.

The amount of achievable plastic strain in each pass of the process is limited and there are some obvious obstacles for industrial application of it. However, two main advantages of the existing methods, for example, the Equal channel angular deformation (ECAD) method are unlimited length of processed specimen and ability of using it as an intermediate step in a continuous industrial process.

A shear drawing (SD) process is presented to overcome flow instability of the ECAD. In this process, the geometry of die channels changed to cone shape and corner radius at the intersection angle. The initial diameter of raw specimen decreases at each step of the SD process. From existing studies, researchers have proposed a continuous hybrid process for manufacturing high strength low carbon steel wires. In this process, a hybrid of wire drawing, ECAP, and rolling process are used as a new severe plastic deformation (SPD) technique.

The ECAP-Conform process is introduced as a continuous severe plastic deformation (SPD) method to produce ultra-fine grain (UFG) materials. In order to increase frictional forces during the conform process, the round cross-section of initial samples change to square. The outlet channel has an intersection angle ranging between 90°-110°. Low production rate and changing of the shape of the sample cross-section are some limitations of the ECAP-conform process. Moreover, existing torsion deformation methods efficiently impose a shear strain to the samples.

In one study, researchers have used locally heated zone and torsion strain for continuous grain refinement of Al rods. Some SPD methods have been introduced based on torsion deformation like high-pressure torsion (HPT), high pressure shearing, and cone-cone method (CCM). The evolution of microstructures in commercial pure Al and Cu deformed by torsion has been investigated. The results have shown that the grain size decreased and fraction of high angle grain boundaries increased with increasing plastic strain in torsion deformation. Therefore, torsion deformation could be a kind of SPD method. Another study suggested a new continuous SPD method for wires with small diameter based on conventional high-pressure torsion (HPT) technique. However, the processed wires after (HPT) had a poor surface quality and the cross section of the wires decreased about 30 percent.

Applicants have here addressed the great need for an apparatus, which produces a non-uniform grain structure in the fabricated wire. Moreover, Applicants have here addressed the unresolved need for an apparatus or a method, which has the ability to impose continuous plastic deformation to wires with acceptable speed and high production rate. Applicants have also discovered an apparatus and method, which is capable of achieving the highest level of plastic strain and which produces a continuous torsion deformation to a wire with diameter below 4 mm.

FIG. 1 exemplarily illustrates a schematic diagram of an ultra-fine wire fabrication method. As used herein, the "ultra-fine wire fabrication method" is also referred to as the "Equal Channel Angular Torsion Drawing (ECATD) method". A schematic diagram of the ECATD method is shown in FIG. 1. First, the initial wire 101 is bent and put into a hollow inclined channel 102 configured on an inner surface 103*a* of a stationary die 103. Then, the wire 101 is drawn through the die 103. Simultaneously, a rotary die holder 104 rotates about the X-axis relative to the stationary die 103 and the wire 101 is forced to turn with the rotary die holder 104. This rotary motion causes torsional deformation to occur in the wire 101. During the ECATD process, the initial wire 101 is subjected to a large plastic deformation combining the effects of pure and simple shear. The hollow inclined channel 102 of the stationary die 103 and torsion deformation by the rotary die holder 104 causes this plastic deformation. Therefore, the severe plastic deformation could be imposed to the initial wire 101 continuously without any limitation in length. In an embodiment, the whole process is repeated to achieve a desirable level of plastic strain.

Figure 2:
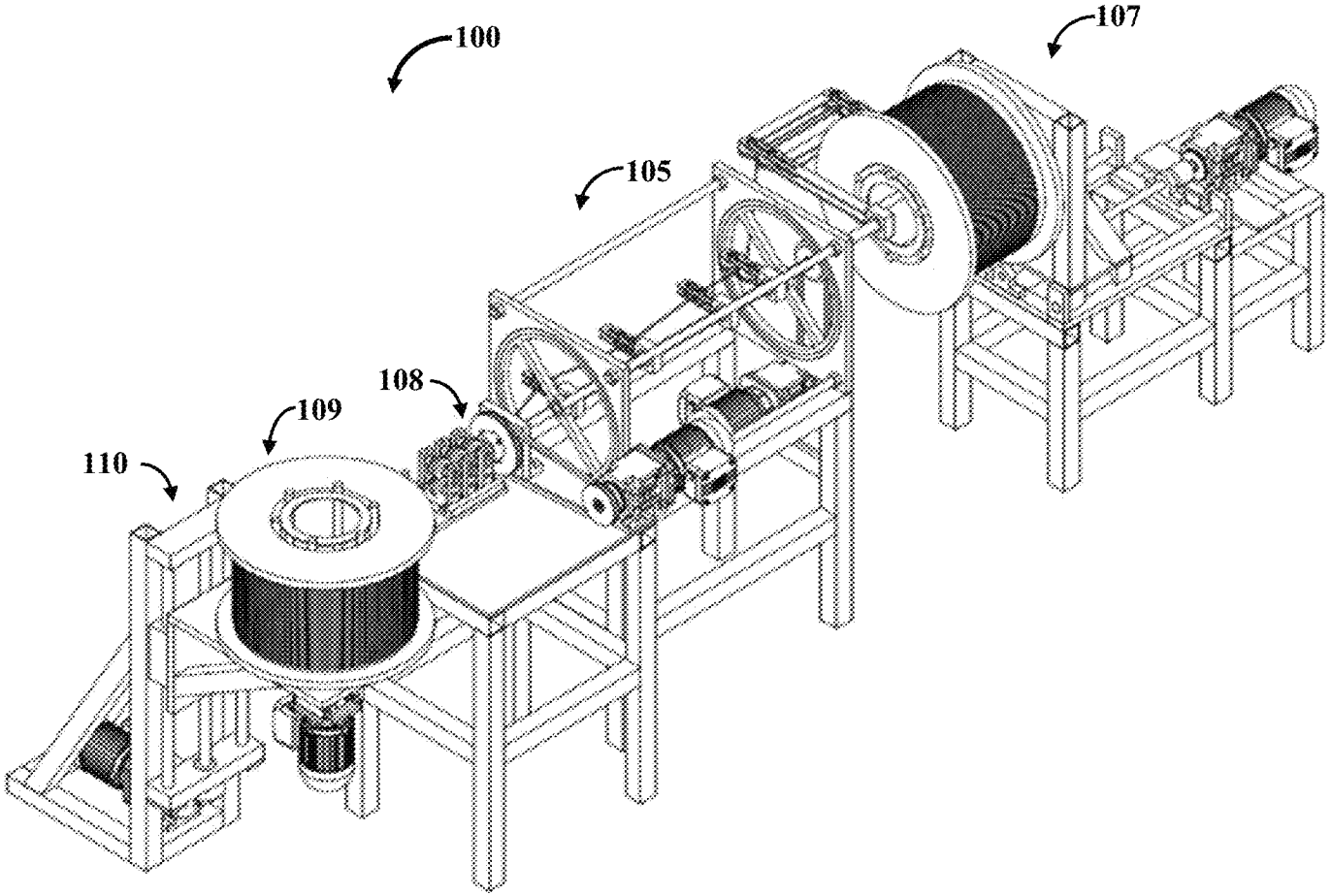
FIG. 2 exemplarily illustrates a perspective view of an ultra-fine wire fabrication apparatus.
Figure 4:
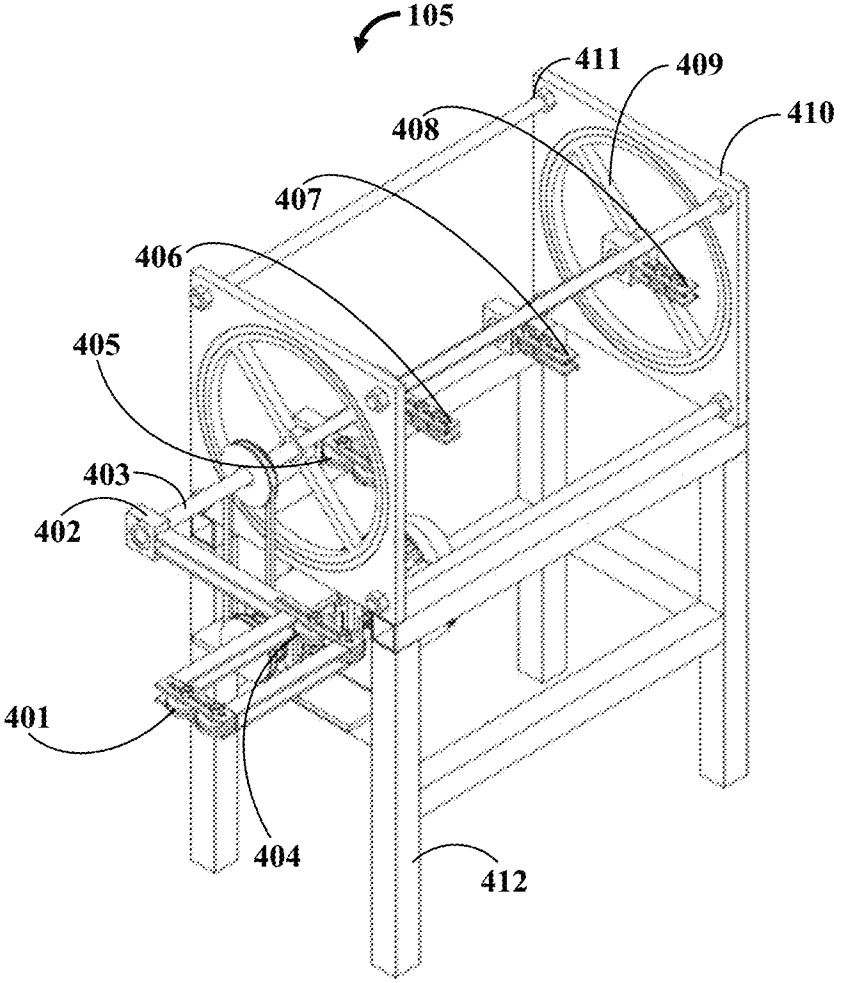
FIG. 4 exemplarily illustrates a perspective view of a feeder assembly of an ultra-fine wire fabrication apparatus.

The ultra-fine wire fabricating apparatus 100 for producing an ultra-fine wire with improved mechanical properties also comprises a feeder assembly 105 for supplying the wire 101 as exemplarily illustrated in FIGS. 2 and 4. The stationary die 103 comprises a hollow inclined channel 102 configured on an inner surface 103*a* of the stationary die 103. Moreover, the hollow inclined channel 102 is configured to receive the wire 101 from the feeder assembly 105 as exemplarily illustrated in FIG. 2. The rotary die holder 104 is configured to receive the wire 101 from the stationary die 103 and simultaneously torsionally deform the wire 101. The rotary die holder 104 rotates relative to the stationary die 103 to produce the ultra-fine wire 106 with improved mechanical properties.

FIG. 2 exemplarily illustrates a perspective view of an ultra-fine wire fabrication apparatus 100. The ultra-fine wire fabrication apparatus 100 comprises the payoff spool assembly 107, the feeder assembly 105, the deformation zone 108, the pick-up spool assembly 109, and the drawing block 110. In an embodiment, a control unit is provided for setting the process parameters and monitoring the entire process. The process parameters comprise, for example, a rotational speed of the rotary die holder, a drawing speed of a drawing block, a rate of fabrication of the ultra-fine wire, a diameter of the ultra-fine wire, a length of the ultra-fine wire, a quantity of the ultra-fine wire, etc. The principle is to apply severe plastic deformation (SPD) to initial wires 101 without limitation in length or material continuously.

SPD processes lead to microstructure evolution and decrease the grain size of the raw materials. The mechanical properties of the initial material significantly improve by increasing the fraction of high angle grain boundaries due to severe plastic deformation. With the aid of intersection angle of the stationary die 103, exemplarily illustrated in FIG. 1, and torsion deformation, the amount of attainable plastic strain in each pass of the process increases. This leads to reducing the number of passes required to achieve the desired level of plastic strain in the initial wires 101. Consequently, the time needed to reach the favorable properties also reduce. Most of the components used in the ultra-fine wire fabrication apparatus 100 are standard and easily accessible. Cost-effectiveness and acceptable price of the processed products is a feature that is considered to produce ultra-fine wires 106 with fine grains as exemplarily illustrated in FIG. 1.

Figure 3:
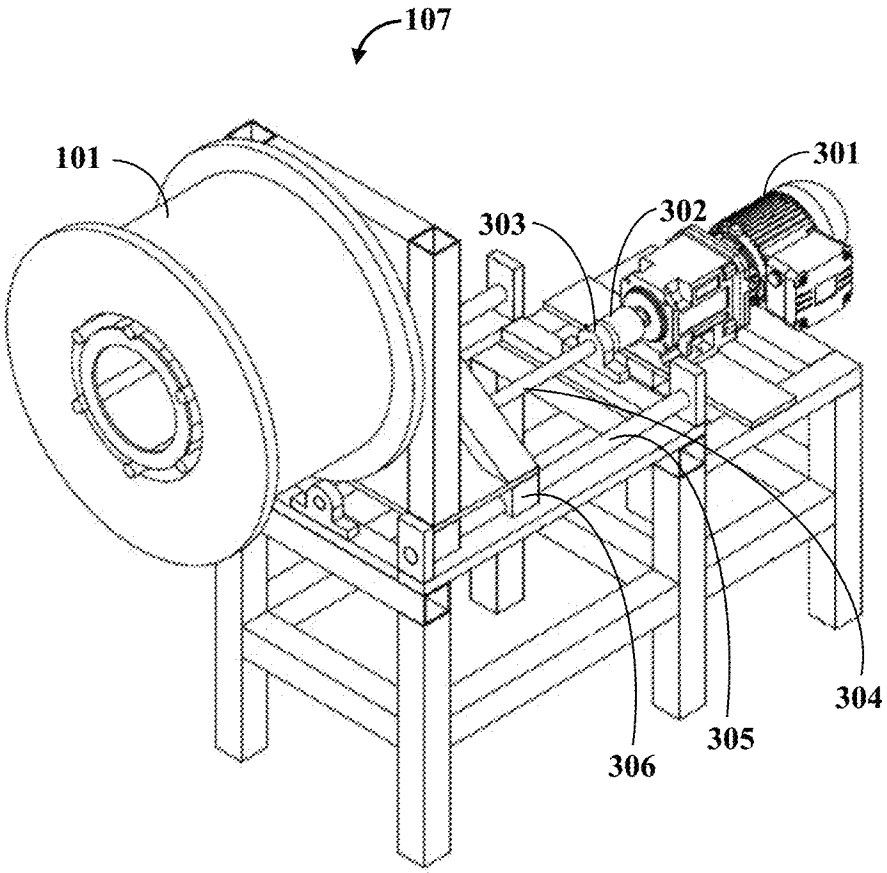
FIG. 3 exemplarily illustrates a perspective view of a payoff spool assembly of an ultra-fine wire fabrication apparatus.

FIG. 3 exemplarily illustrates a perspective view of a payoff spool assembly 107 of an ultra-fine wire fabrication apparatus 100. The initial wire 101 in coil form is placed on the payoff spool assembly 107. During the process, the initial wire 101 is pulled to the deformation zone 108 continuously. In order to simplify the wire feeding process, a linear motion system comprising a ball screw, a ball-screw nut bracket 304, linear motion rails 305, and the open plain linear bearing pillow blocks 306 is used. An AC motor 301 and a shaft coupling 302 is used to rotate the ball screw. The ball screw is fixed in its position by simple support units 303. By using these facilities, the initial wire 101, payoff spool assembly 107, and ball-screw nut bracket 304 and its supporting plate can be moved along the X-axis. As a result, the initial wire 101 is easily and continuously driven to the deformation zone 108 exemplarily illustrated in FIG. 5.

One aspect of the present disclosure is directed to an ultra-fine wire fabricating apparatus for producing an ultra-fine wire with improved mechanical properties. The ultra-fine wire fabricating apparatus comprises a feeder assembly for supplying a wire; and a stationary die comprising a hollow inclined channel configured on an inner surface of the stationary die, the hollow inclined channel configured to receive the wire from the feeder assembly. The apparatus further comprises a rotary die holder configured to receive the wire from the stationary die and simultaneously torsionally deform the wire, wherein the rotary die holder rotates relative to the stationary die to produce the ultra-fine wire with improved mechanical properties.

FIG. 4 exemplarily illustrates a perspective view of a feeder assembly 105 of an ultra-fine wire fabrication apparatus 100. Then the wire 101 is pulled through the rollers 401 as shown in FIG. 4. This roller unit with its associated components 402 turn around the axis of the shaft 403. The shaft 403 is connected to an AC motor by a belt and pulleys. After that, the wire 101 goes through the rollers 404 and 405. The wire 101 is drawn into the die channel guiding through the rollers 406, 407, and 408. These rollers are designed to guide the wire 101 into the deformation zone 108, exemplarily illustrated in FIG. 5, appropriately. Moreover, the distance between the rollers 405, 406, 407, and 408 can be adjusted for wires 101 with different diameters. Moreover, the distance between the rollers 405, 406, 407, and 408 can be adjusted to provide the best guidance for the wire 101. All of these roller units 405, 406, 407, and 408 rotate around the axis of the shaft 403. Moreover, the roller units 405, 406, 407, and 408 are assembled on the shaft 403 using multiple keys. In order to stabilize the operation of the feeder assembly 105 during the deformation process, a part 409, its retaining block 410, and some screws 411 are designed. All of the above-mentioned components of the feeder assembly 105 are placed on the chassis 412.

Figure 5:
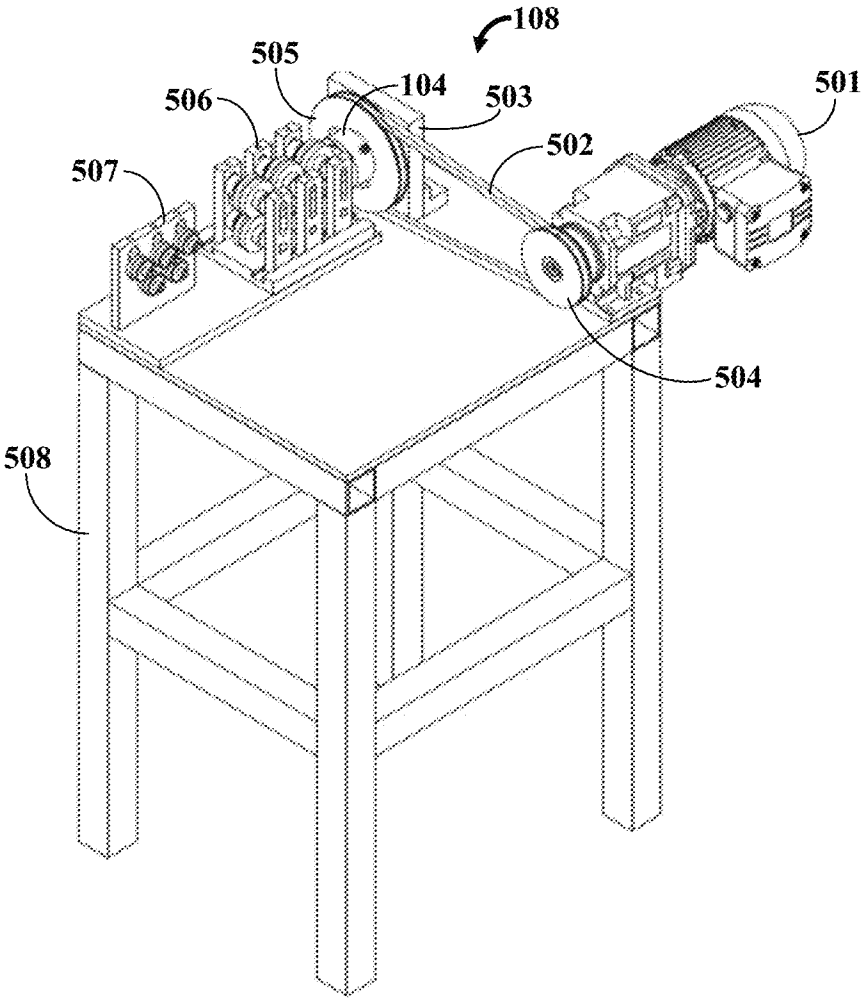
FIG. 5 exemplarily illustrates a perspective view of a deformation zone of an ultra-fine wire fabrication apparatus.

FIG. 5 exemplarily illustrates a perspective view of a deformation zone 108 of an ultra-fine wire fabrication apparatus 100. Then to apply severe torsion deformation using the proposed Equal Channel Angular Torsion Drawing (ECATD) method, the system shown in FIG. 5 is used. The stationary die 103 is placed in the rotary die holder 104 as exemplarily illustrated in FIG. 1. This part is assembled in the block 503 using a ball bearing. In order to apply torsion to the wires, the rotary die holder 104 rotates around its axis. For this purpose, an AC motor 501 is connected to the rotary die holder 104 by the pulleys 504 and 505 and a belt 502. After plastic deformation, the deformed wire is pulled through guiding units 506 and 507 to the drawing block 110 exemplarily illustrated in FIG. 6. All of these parts are placed on a chassis 508.

The ultra-fine wire fabricating apparatus may further comprise a pick-up spool assembly operably engaged to the rotary die holder for collecting the fabricated ultra-fine wire. The ultra-fine wire fabricating apparatus may further comprise a control unit for controlling one or more parameters of the ultra-fine wire fabricating apparatus. The one or more parameters may comprise a rotational speed of the rotary die holder, a drawing speed of a drawing block, and a rate of fabrication of the ultra-fine wire. The one or more parameters may comprise a diameter of the ultra-fine wire, a length of the ultra-fine wire, and a quantity of the ultra-fine wire.

Figure 6:
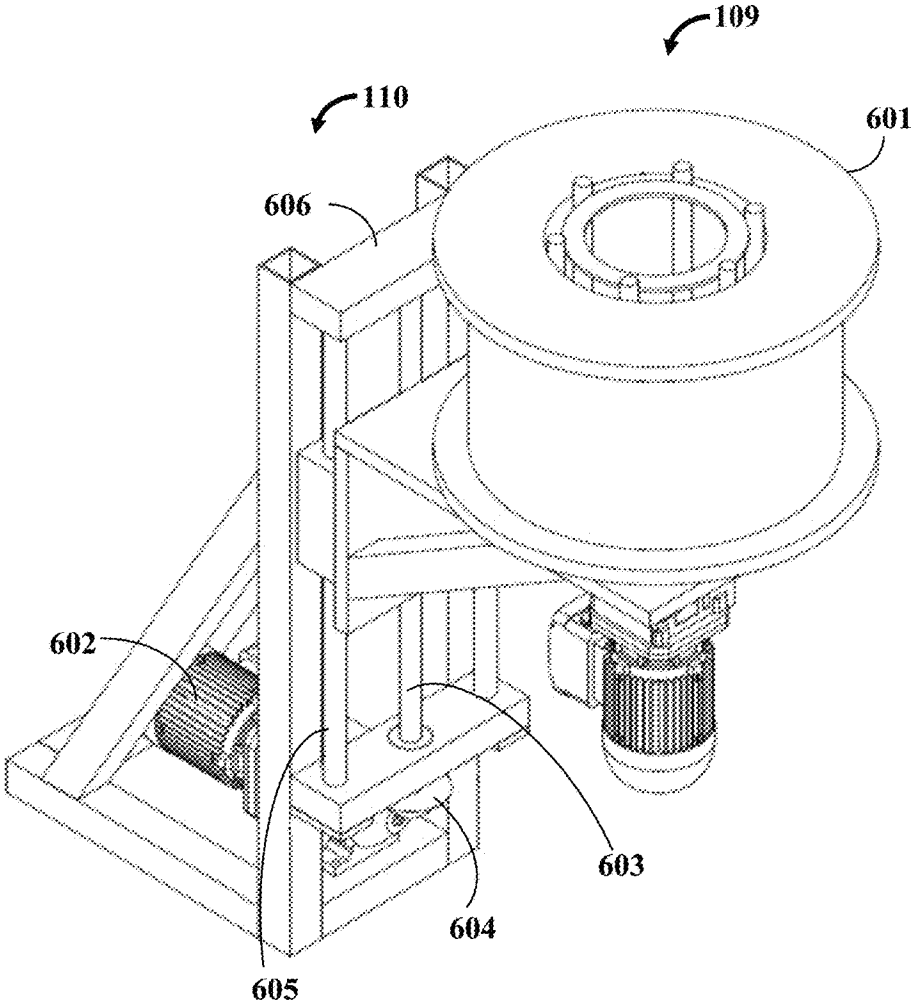
FIG. 6 exemplarily illustrates a perspective view of a pick-up spool assembly of an ultra-fine wire fabrication apparatus.

FIG. 6 exemplarily illustrates a perspective view of a pick-up spool assembly 109 of an ultra-fine wire fabrication apparatus 100. In an embodiment, the pick-up spool assembly 109 is operably engaged to the rotary die holder 105 for collecting the fabricated ultra-fine wire 106 as exemplarily illustrated in FIG. 1. The drawing block 110 and its components are illustrated in FIG. 6. The drawing process is performed by a winding part 601 placed on the pick-up spool 109, which is rotated using an AC motor 602. In order to increase the simplicity of the wrapping process and prevent undesirable deformations a vertical motion system is designed. A ball screw 603 that is connected to an AC motor 602 by two bevel gears 604 supplies the vertical motion. For smooth and accurate motion of the pick-up spool assembly 109, two guide shafts 605 are used. The guide shafts 605 and ball screw 603 are restrained in two plates 606 by some bearings. The whole parts are placed on a chassis. After one pass of the deformation, the part 601 with the processed wire 106 on it is placed as an initial material on the payoff spool 107 exemplarily illustrated in FIG. 2.

The whole process can be repeated to reach the desirable level of equivalent plastic strain. Drawing and rotational speed of the process should be determined based on the intersection angle of the stationary die 103, the diameter of the initial wire 101, and the material of the initial wire 101 as exemplarily illustrated in FIG. 1. These parameters are adjusted in such a way that the maximum possible plastic strain is imposed to the initial wire 101 without failure or fracture.

The Equal Channel Angular Torsion Deformation (ECATD) method has the ability to impose continuous severe plastic deformation to wires 101 with acceptable speed and high production rate. Additionally, the ECATD method is simple and cheap. There is no need for expensive equipment and facilities. In the proposed method here (ECATD), the final structure would be a mix of fine and coarse grains mainly due to the effects of torsion deformation. Therefore, the processed wires will have high strength plus acceptable toughness. Fine grained structure wires can be extensively used in many industries such as springs manufacturing companies, tire manufacturing companies, electric and electronic industries, power supply and power transmission companies, elevators and cranes manufacturing companies, automobiles, etc.

Another aspect of the present disclosure is directed to a method for producing an ultra-fine wire with improved mechanical properties. The method comprises providing an ultra-fine wire fabricating apparatus comprising: a feeder assembly; a stationary die; and a rotary die holder. The method further comprises supplying a wire via the feeder assembly; bending the wire in a hollow inclined channel of the stationary die; and applying a torsion deformation on the wire by rotating the rotary die holder to produce the ultra-fine wire with improved mechanical properties.

Figure 7:
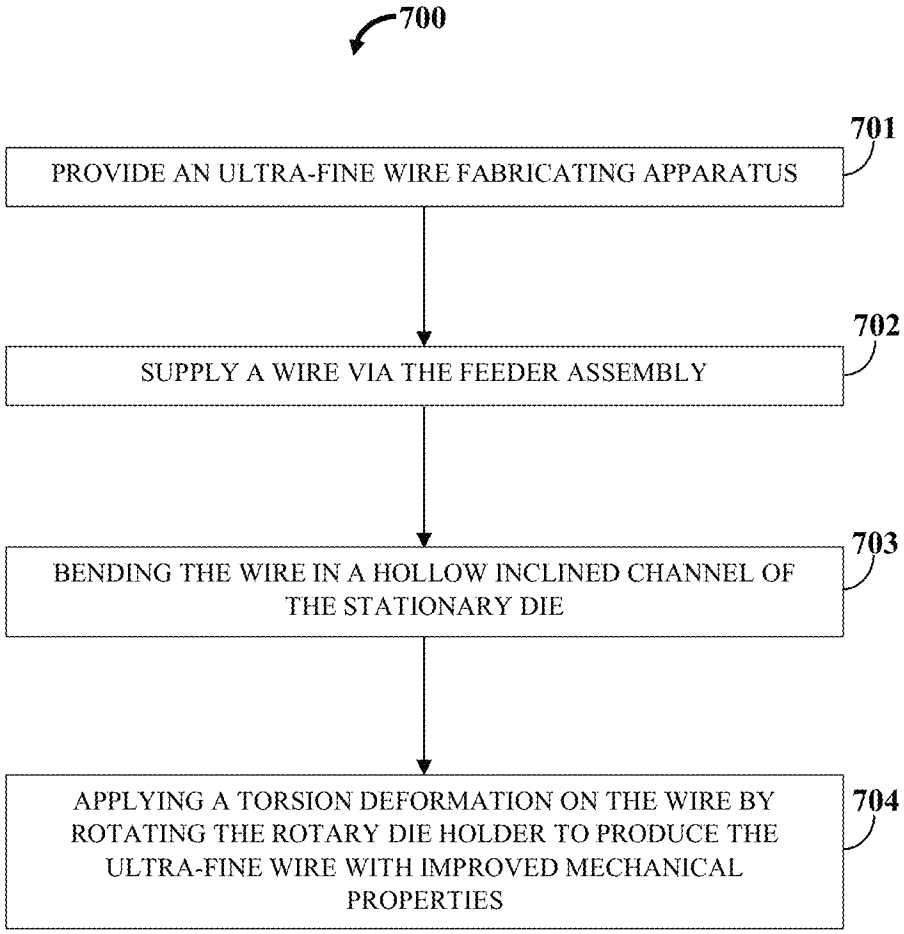
FIG. 7 exemplarily illustrates a flowchart showing a method for producing an ultra-fine wire with improved mechanical properties.

FIG. 7 exemplarily illustrates a flowchart showing a method 700 for producing an ultra-fine wire 106 with improved mechanical properties as exemplarily illustrated in FIG. 1. In step 701, an ultra-fine wire fabricating apparatus 100 is provided. In Step 702, the feeder assembly 105 exemplarily illustrated in FIG. 2 supplies a wire 101. In Step 703, a hollow inclined channel 102 of the stationary die 103 bends the received wire as exemplarily illustrated in FIG. 1. In Step 704, the rotary die holder 104 applies a torsional deformation on the wire by rotation to produce the ultra-fine wire 106 with improved mechanical properties as exemplarily illustrated in FIG. 1.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method.

Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. An ultra-fine wire fabricating apparatus for producing an ultra-fine wire with improved mechanical properties, the ultra-fine wire fabricating apparatus comprising:

a feeder assembly for supplying a wire;

wherein the wire is 4 mm in diameter;

wherein the feeder assembly comprises a roller unit configured to supply wire to a hollow inclined channel of a stationary die;

the stationary die is placed in a rotary die holder, the hollow inclined channel configured on an inner surface of the stationary die, the hollow inclined channel configured to receive the wire from the feeder assembly; and wherein the rotary die holder rotates about a X-axis relative to the stationary die, is configured to receive the wire from the hollow inclined channel of the stationary die, and the rotary motion of the rotary die holder causes torsional deformation in the wire simultaneously, to produce ultra-fine wire with improved mechanical properties;

a pick-up spool assembly operably engaged to the rotary die holder for collecting the fabricated ultra-fine wire.

2. The ultra-fine wire fabricating apparatus of claim 1, wherein the rotary die holder is connected to a motor, via a pulley and a belt.

* * * * *